United States Patent [19]

Bernardet

[11] Patent Number: 4,939,425

[45] Date of Patent: Jul. 3, 1990

[54] FOUR-ELECTRODE ION SOURCE

[75] Inventor: Henri Bernardet, Saint Michel Sur Orge, France

[73] Assignee: U.S. Philips Corporation, New York, N.Y.

[21] Appl. No.: 205,124

[22] Filed: Jun. 10, 1988

[30] Foreign Application Priority Data

Jun. 12, 1987 [FR] France ..... 87 08196

[51] Int. Cl.[5] ..... H01J 29/00; H01J 17/26

[52] U.S. Cl. ..... 315/111.21; 315/111.81; 313/231.41; 313/362.1; 250/426

[58] Field of Search ..... 315/111.21, 111.81; 313/231.41, 362.1; 250/426

[56] References Cited

U.S. PATENT DOCUMENTS 3,097,321 7/1963 Row, Jr. et al. ..... 313/231.41

3,356,897 12/1967 Barr, Jr. et al. ..... 313/231.41

*Primary Examiner*—Eugene R. LaRoche

*Assistant Examiner*—Michael B. Shingleton

*Attorney, Agent, or Firm*—Paul R. Miller

[57] ABSTRACT

A vacuum arc ion source comprises an anode (2 or 3) and a cathode (1) which face each other and whose plasma (7) is emitted perpendicularly to the cathode surface. The projection of this plasma is obtained by means of two independent appropriately biased grids (4 and 5).

8 Claims, 2 Drawing Sheets

FOUR-ELECTRODE ION SOURCE

Figure 1A:
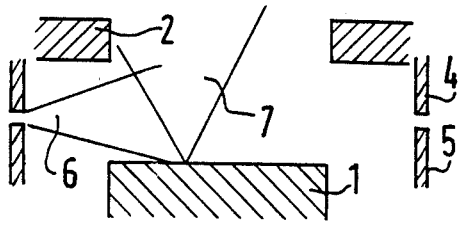

The invention relates to a vacuum arc ion source comprising an anode and a cathode which face each other, which are biased at different potentials and whose main arc resulting in the formation of a plasma directed perpendicularly to the cathode surface is triggered by the projection of a further plasma between the anode and the cathode during a period of time which is short relative to the length of the arc pulse.

When an arc is produced between two electrodes placed in a vacuum, the material of the electrodes is locally evaporated by heating. This results in the formation of a plasma, that is to say in an ion-electrode mix having a total charge equal to zero.

The emission of this plasma which is projected with an average energy of some dozens of electron volts is effected from very bright points of very small dimensions, designated cathode spots, and the amount of ions in the plasma represents a certain percentage (5 to 10%) of the electric charge conveyed by the arc.

The projection is of a conical shape. The ions can be extracted by means of an acceleration electrode which is brought to a negative voltage, and an extraction electrode, where it is possible for the latter to be, for example, of the anti-micro-particle projection system.

The ion sources are used to create ions in isotopic separators, mass spectrometers, implanters, plasma machines, accelerator tubes, neutron tubes etc. They generally utilize the ionization of gas injected in a quasi-closed volume.

Compared to such gaseous discharge sources such as the Penning source, the vacuum arc sources have the following advantages:

small dimensions for the production of the plasma, high metallic ion flow rates which permit the use of large extraction surfaces, and operation in a vacuum and consequently high rate differential pumping systems are not required to reduce the gas pressure in the ion acceleration zone.

The vacuum arc ion sources of the type defined in the opening paragraph are of a three-electrode structure: anode, cathode and an arc control grid. An example of a currently used structure is given in the article: "Metal Vapor Vacuum Ion Source", by T. G. Brown et al., published in the Review of Scientist Instruments, volume 57, No. 6, June 1986, pages 1069–1084.

The invention has for its object to increase:

the ease of electric control by means of a generator which may be independent relative to electric biasing, the simplicity of mounting the cathode of the ion source, which is made independent of the grid, and which no longer requires reduced mechanical tolerances as in the above-mentioned document, and the operating life and the reliability of the ion sources by increasing the active portion of the grids and by removing them from the cathode, whose surface is significantly corroded and often deformed by cathode spots (ie., risk of short-circuiting after local fusions or extensive metal deposits) .

To that effect, the ion source according to the invention is characterized in that the projection of the initial plasma is obtained by means of two independent grids, one of which, the cathode grid, can be near the anode, and the other, the anode grid, can be near the cathode and be appropriately biased relative to the anode and the cathode.

These grids are constituted by, for example, the superpositioning of two concentric round rings which are separated one from the other, the anode and the cathode being disposed in the center zone of the rings and symmetrical relative to their axis.

The following description which is given by way of non-limitative example with reference to the accompanying drawing will make it better understood how the invention may be put into effect.

Figure 1B:
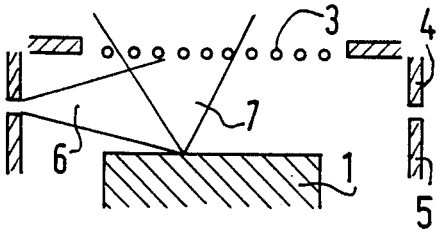

FIGS. 1*a* and 1*b* are cross-sectional views of the basic circuit diagram of an ion source according to the invention.

Figure 2:
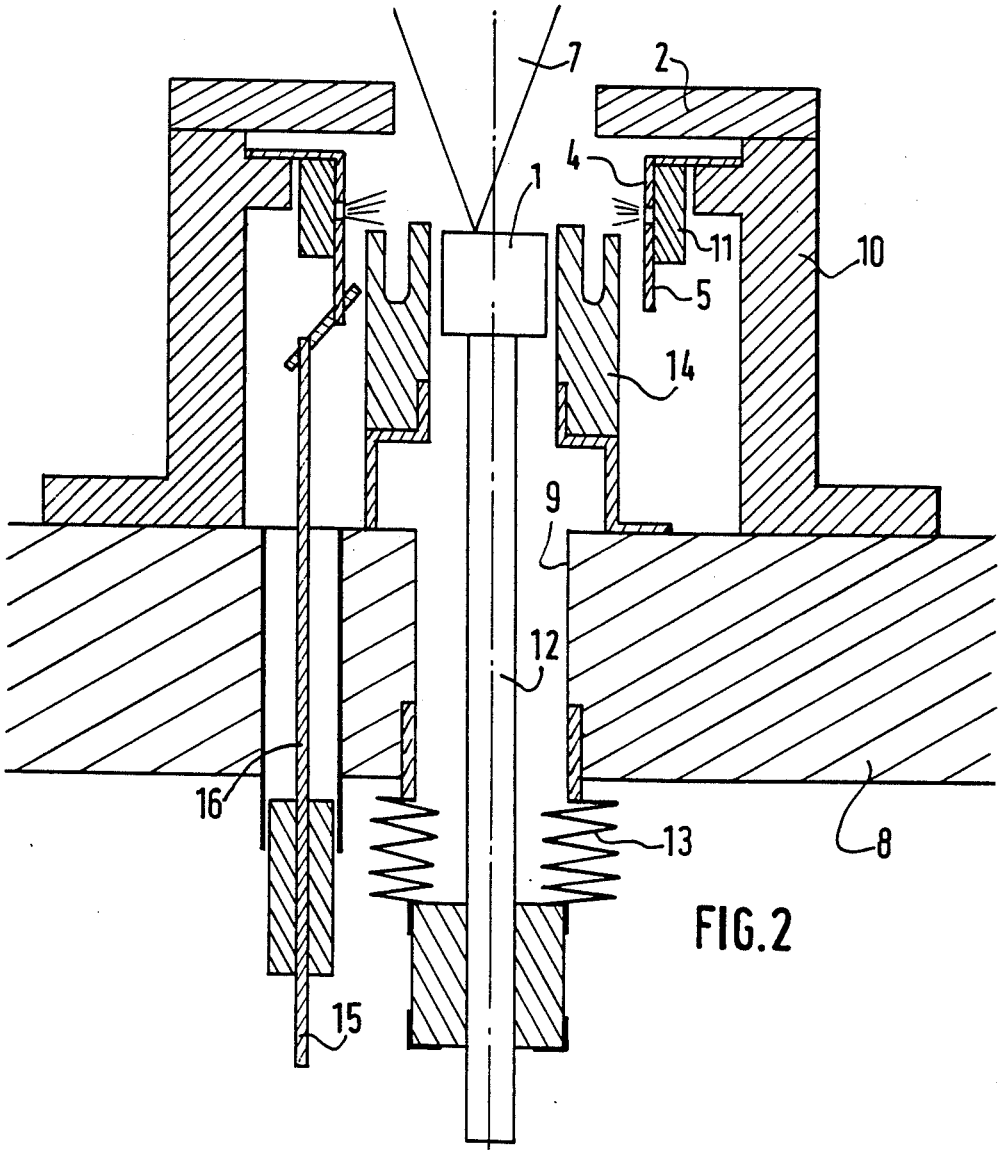

FIG. 2 shows a specific embodiment of such a source.

Figure 3A:
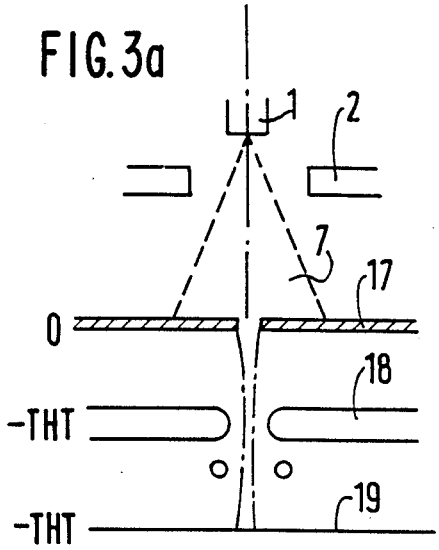

FIGS. 3*a, b, c,* and *d* show the circuit diagrams of some types of extraction electrodes.

In the cross-sectional view of FIG. 1 a cathode 1 of a cylindrical shape is placed opposite an anode.

This anode may be a metallic disk 2 in which a circular hole has been made in the center in the manner shown in FIG. 1*a*, or a metallic grating 3 of a type as shown in FIG. 1*b*.

Two superposed independent grids 4 and 5 in the form of concentric circular rings surround the active portion of the anode and the cathode. These rings are constituted by:

either two solid, annular metallic electrodes which are separated by a small gap, or a metallic layer with or without hydride deposited on an insulating substrate and on which a groove has been made which ensures that they are separated from each other, or a semiconductor layer with plasma emission by conduction (for example a carbon layer) and likewise bounded by a groove.

These various electrodes (anode, cathode and independent grids) are appropriately biased by sources, not shown. Triggering an arc between the grids 4 and 5 produces a plasma, denoted as the control plasma. The control plasma behaves as an electric conductor of extendable shape; when it passes between the cathode and the anode of the ion source, a short-circuit is produced between these two electrodes: the electrons of the plasma are attracted by the anode and the ions by the cathode. The actual physical process is as follows: the electrons of the plasma have a mobility which is much higher than the ions and the control plasma (because of its overall neutral electric charge) will assume the potential of the anode 2 or 3. In these conditions, there appears between the plasma and the cathode 1 the voltage difference applied to the ion source and the ions of the plasma are extracted while creating a cathode sleeve whose height is a function of the ion density of the plasma. The resultant electric field on the cathode is very high and, in accordance with control parameters of the grid (grid current, duration of application: some hundreds of nanoseconds to some microseconds, cathode-to-anode grid distance) striking of the arc may occur (or not occur) . In these conditions, when the electron current between the anode and the cathode is sufficiently high to heat and locally evaporate the cathode, the metallic vapour thus produced is ionized by the electrons and a cathode plasma 7 is formed from very bright points of very small dimensions (cathode spots) . Arcing between the two grids notably facilitates the control of the source in accordance with the invention.

FIG. 2 shows an advantageous embodiment of the invention.

A metallic piece 8 in which a central hole 9 has been pierced serves as a support for the overall device. The support 10 of the anode 2, which is also used to bias it is mounted on this metallic piece. An insulating ring 11 which is an integral part of the support 10 ensures fixing of the grids 4 and 5. The cathode 1 which is mounted on a metallic rod 12 which is passed through the central hole 9 can be adjusted in the longitudinal direction with the aid of the bellows 13; it is insulated from the grids by the ring 14 which is also an integral part of the support 8. The grid polarizing output end 15 is passed through a further aperture 16 produced likewise in the support 8. The cathode plasma 7 is generated in the manner described in the foregoing.

Figure 3B:
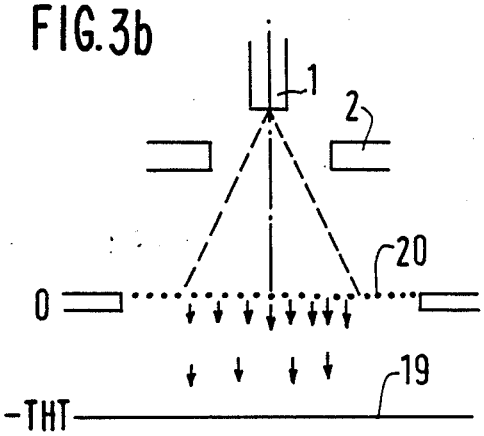
Figure 3C:
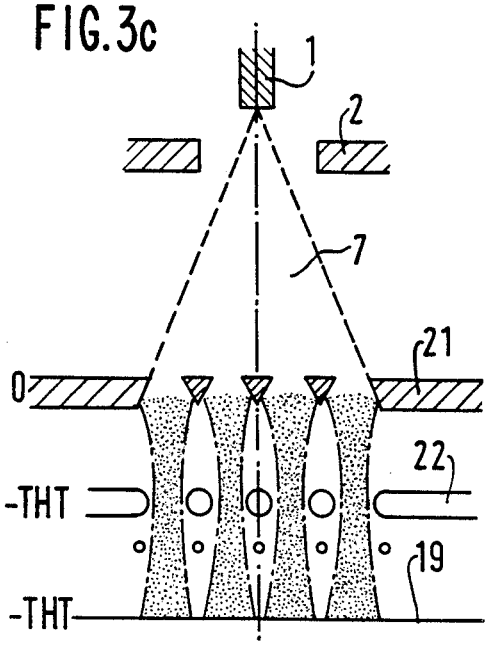
Figure 3D:
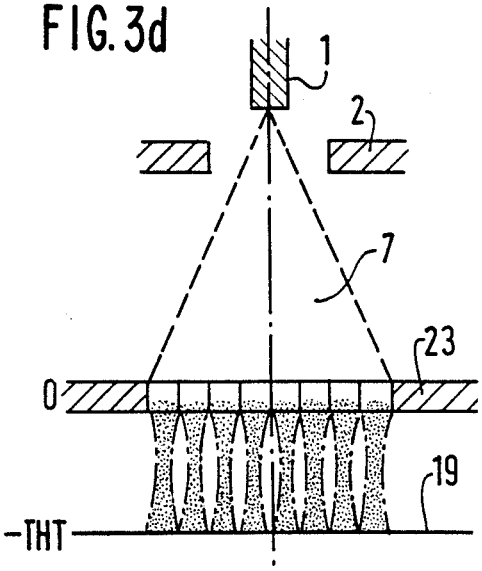

FIG. 3 shows some examples of electrode extraction, limiting the expansion volume of the cathode plasma 7; the shape and structure of this electrode are a function of the applied mode accelerating ions, as will be apparent from the following diagrams:

FIG. 3*a*: a structure with one pinhole type of orifice 17 resulting in extracted beams of limited flow and projected onto a target 19 via an accelerating electrode 18, FIG. 3*b*: a structure having one single highly transparent grid 20 used, for example to bombard an electrode 19, FIG. 3*c*: a structure having one (or several) extraction orifice(s) 21 of a shape compatible with the accelerating electrodes 22 and resulting in a perfectly controlled definition of the extracted beam(s), FIG. 3*d*: a structure 23 of the "bee hive" type 23 by means of which the flux density variations of the cathode plasma during the extraction can be reduced.

These types of structures can be used more specifically for the embodiment of the ion source shown by way of example in FIG. 2.

I claim:

1. A vacuum arc ion source comprising anode means and cathode means for forming a main arc between said anode means and said cathode means, said anode means facing toward said cathode means, and said anode means being biased at a different potential than said cathode means;

anode grid means and cathode grid means for forming a control plasma between said anode means and said cathode means to trigger said main arc into a plasma, said anode grid means being independent of said cathode grid means, and said anode grid means and said cathode grid means being appropriately biased relative to said anode means and said cathode means.

2. An ion source according to claim 1, wherein said cathode ray grid means is disposed near said anode means, and said anode grid means is disposed near said cathode means.

3. An ion source according to claim 1 or claim 2, wherein said anode grid means and said cathode grid means are two separated, concentric, annular rings disposed symmetrically about an axis between said cathode means and said anode means, and wherein said anode means and said cathode means are disposed in a central zone of said annular rings.

4. An ion source according to claim 3, wherein said two annular rings are two solid, annular metallic electrodes separated by a small gap.

5. An ion source according to claim 3, wherein said two annular rings are a metallic layer disposed on an insulating support and separated by a groove through said metallic layer.

6. An ion source according to claim 5, wherein said metallic layer includes hydride.

7. An ion source according to claim 3, wherein said two annular rings are a semiconductor layer providing plasma emission by conduction and separated by a groove through said semiconductor layer.

8. An ion source according to claim 7, wherein said semiconductor layer includes a carbon layer.

* * * * *